United States Patent [19]

Weisgerber

[11] Patent Number: 4,643,414

[45] Date of Patent: Feb. 17, 1987

[54] SHEET-DELIVERY CONTROL AND REGULATING APPARATUS

[75] Inventor: Willi Weisgerber, Johannisberg, Fed. Rep. of Germany

[73] Assignee: Miller-Johannisberg Druckmaschinen GmbH, Wiesbaden-Biebrich, Fed. Rep. of Germany

[21] Appl. No.: 723,334

[22] Filed: Apr. 15, 1985

[51] Int. Cl.[4] ..... B65H 29/68

[52] U.S. Cl. ..... 271/183; 271/202; 271/206; 271/211; 271/309

[58] Field of Search ..... 271/183, 202, 204, 206, 271/211, 309

[56] References Cited

U.S. PATENT DOCUMENTS

| | | | |
|---|---|---|---|
| 2,657,052 | 10/1953 | Elliott | 271/183 |
| 3,136,541 | 6/1964 | Peyrebrune | 271/206 X |
| 3,451,670 | 6/1969 | Staines | 271/183 |
| 3,556,519 | 1/1971 | Keller | 271/211 X |
| 3,703,281 | 11/1972 | Liebert | 271/206 |
| 3,730,517 | 5/1973 | Norton | 271/204 X |
| 3,948,508 | 4/1976 | Kanazawa | 271/206 |
| 4,083,556 | 4/1978 | Schilling | 271/204 |
| 4,085,930 | 4/1978 | Weisgerber | 271/204 |
| 4,395,038 | 7/1983 | Fitzpatrick | 271/211 X |

*Primary Examiner*—Richard A. Schacher

[57] ABSTRACT

A control and regulating apparatus for a sheet-delivery device for sheet-processing machines, and in particular, for sheet-printing machines, is provided.

Several of the adjustable elements of the delivery device have separate control motors with feedback of the setting attained to a reference-value-setting meansor they have electromagnetic valves. The reference-value-setting means is provided with a respective input means for paper weight, sheet format and speed of rotation of the machine, and it is connected to or integrated with a computer which supplies to the reference-value-setting means the reference values in respect of all settings of the feeder, such reference values being empirically determined for each operating condition and stored in the form of a family or characteristics.

7 Claims, 10 Drawing Figures

SHEET-DELIVERY CONTROL AND REGULATING APPARATUS

BACKGROUND AND SUMMARY OF THE INVENTION

This invention relates to a control and regulating apparatus of a sheet-delivery device, in particular for sheet-processing machines.

With sheet-delivery devices of this kind, the individual sheets which have been processed by the machine in some manner, for example, printed, coated or processed in some other way, are removed from the sheet-processing machine by means of gripper arrays which are mounted on two circulating, mutually parallel chains; then, by way of a row, which row extends transversely with respect to the direction of movement of the sheets, of suction wheels which apply a braking or a lift-off action to each sheet, or by means of a corresponding continuous suction roller, or by another means of applying a braking action, the sheets which have been removed from the machine are braked before they are deposited above a receiving stack, and then deposited on the top of the stack. This operation is effected by the grippers' which guide the individual sheets being opened by means of a gripper-opening cam, and more specifically, the time at which the grippers are opened is adjustable in accordance with certain features and details of the sheets, as set out in detail hereinafter, and also of the machine. For reasons which also depends on the properties of the material being printed and the printing machine, both peripheral speed of the suction wheels (or suction roller) and the increased or reduced pressure applied at the suction wheels or the suction roller are also adjustable.

If hereinafter in this specification, reference is only made to sheet-delivery devices for sheet-fed printing machines, that is intended only to be by way of example in regard to the sheet-delivery devices of other machines for processing sheets or reels. (In the case of reel-processing machines, the web of material, after being printed or the like, can be cut into sheets and also deposited in sheet-delivery devices.) This mode of expression is used only in order for the description to be drafted in shorter and clearer form. However, it is not intended to restrict the scope of the protection claimed to sheet-delivery apparatus for sheet-fed printing machines, but on the contrary, the scope of protection claimed is intended to extend to the delivery and distributing or depositing devices of all machines in which sheets are subject to processing in some manner and then fed out of the machine and deposited or distributed.

In sheet-processing machines, for example, sheet-fed printing machines, precautions in respect of safety and programming are taken for almost all parts or elements of the machine. There are defective-sheet controls, double-sheet controls, sheet-checking operations at the individual printing rolls; there is also programming in respect of printing programs which have already been carried out at the inking mechanisms and at the damping mechanisms; there are controls in respect of premature sheets, retarded sheets and defective sheets; there are side-mark controls; there is the control in respect of sheet transfer from roll to roll and from printing mechanism to printing mechanism; and there are crumple- or crease-sheet safeguards, and many more.

Hitherto, there was nothing of that kind for a sheet-delivery device. The correct setting of the various adjustable elements of a sheet-delivery device involves a whole series of factors, including the quality of the paper (weight of the paper per unit of area); operating speed (rotary speed) of the machine, more specifically during the start-up and shut-down phases, compared with the continuous or steady-state printing operation (for example, a larger number of sheets are printed until the desired operating printing speed is reached); in addition, a part is also played by the format and also the printed image, that is to say, the amount (and thus the weight and distribution) of the ink on each individual sheet. Correct presetting and continuous resetting of the device, for example, when there are changes in the speed of rotation or after any intentional or unintentional stoppage of the machine, which has a whole series of different forms of adjustability, has hitherto been left to the attentiveness, the capability, and the skill of the printer. Until the printer has found the optimum setting for all elements of the sheet-delivery device, more particularly having regard to the large number of possible adjustments and settings available, there may be a considerable amount of wastage, a corresponding loss of material, and a decrease in the overall productivity of the printing machine.

Hitherto, a single and only very partial form of automation of the mode of operation of sheet-delivery devices has been known; more specifically, German Patent specification No. 818,365 discloses that the adjustable cam onto which the gripper arrays holding the sheet pass and are thereby opened, and therewith also the time of opening of the grippers is only one of the many adjustment features of a sheet-delivery device, and, as already indicated, the correct time of opening also depends not just on the speed of rotation of the machine but also on many other influences, factors or parameters.

The problem of the present invention is to avoid the above-indicated disadvantages by providing a novel control and regulating apparatus for a sheet-delivery device, which makes it possible for all settings required in respect of the adjustable elements of a sheet-delivery device to be set in the optimum fashion from a single location, and to be automatically re-adjusted to meet fluctuating conditions in accordance with a predetermined program, and thereby to achieve a very considerable saving in time, to avoid wastage of material, and at least substantially to eliminate dependency on the skill, capability, and knowledge of the printer.

According to the present invention, there is provided an apparatus for control and regulating a sheet-delivery device, with which delivery device individual sheets are removed therefrom by means of gripper arrays mounted on two circulating, mutually parallel chains, and guided above a receiving stack by way of a transversely extending row of suction wheels which apply a braking or a lift-off action to each sheet, or a corresponding continuous suction roller, over which stack the grippers are opened by means of a gripper-opening cam which is adjustable to provide for an earlier or later gripper-opening action, and with which the peripheral speed of the suction wheels or suction roller and the reduced or increased pressure applied thereat and the longitudinal setting of the suction wheels or suction roller are adjustable in the direction of the sheet movement of the purposes of adaptation to different sheet-format lengths, wherein, for altering a plurality of the following values (1) to (7):

(1) the speed of rotation of the suction wheels or suction roller;

(2) the longitudinal setting of the suction wheels or suction roller;

(3) the reduced or increased pressure at the suction wheels or the suction roller and switching same on and off and switching over from suction air to blowing air;

(4) adjustment of a gripper-opening cam for varying the time of opening of the sheet grippers;

(5) the speed of rotation and switching on and off of fans which blow downwardly onto the sheet to facilitate the stacking action, or the pressure of another kind of regulatable blowing sources which have the same action and act at a point;

(6) the pressure at pressure-blast nozzles (rake-like blowing unit) which are optionally provided, for fixing and thrusting the sheet downwardly upon deposit thereof, and (7) other adjustable elements of the delivery device, such as a stack-level regulating means, or switching over of the straight thruster motion of an individual stroke movement per sheet, to a shaker motion, there are provided respective separate control motors with feedback of the setting reached to a reference-value-setting means or electromagnetic valves, and wherein the reference-value-setting means is provided with a respective input speed of rotation of the machine, and is connected to or integrated with a computer which computes the reference values for all settings of the feeder, such reference values being determined empirically for each operating condition and being stored in the form of a family of characteristics, said computer outputting said reference values to the reference-value-setting means which transmits same to control motors or electromagnetic valves.

It should be clearly emphasized that the servo adjustment and automatic control or regulation does not have to be provided for all points or values 1 to 7 set forth in the above comprehensive definition of the invention, but that one setting or the other may also be adjusted in conventional manner, while perhaps three or four others of the points specified are automatically controlled or regulated in the manner characterized in the above comprehensive definition of the invention.

The memory and the reference-value-setting means or generator may be a separate element of the machine, which is only associated with the sheet-delivery device; however, they may also be combined with or partially or fully integrated into the computer which is provided in the machine in any case, for example, for the inking-mechanism or damping-mechanism programming and control or with some other computer that is already provided in the machine.

With the reference-value-setting means and/or the computer, there may be provided a memory having interchangeable-memory elements, to which there are connected a first switch which can be switched over from manual setting to automatic setting in respect of the adjustable elements of the apparatus, and a second switch for putting into storage in the memory element the optimum values which are empirically determined by manual setting.

Therefore, in this case also the correct values for the various possible settings of a sheet-delivery device are determined empirically, but the values are then stored and subsequently, when the same printing operation is carried out again, or when a printing operation which is at least fairly similar is performed, those values can be set again by using the memory element which was previously already prepared for that purpose, without the printer's being required to be particularly attentive in that respect. In fact the operation of changing a memory element into a reference-value-setting means requires only a very small amount of time.

DESCRIPTION OF THE DRAWINGS

The invention will be described and explained in greater detail hereinafter with references to the drawings in which.

DESCRIPTION OF THE PREFERRED EMBODIMENTS

Figure 1:
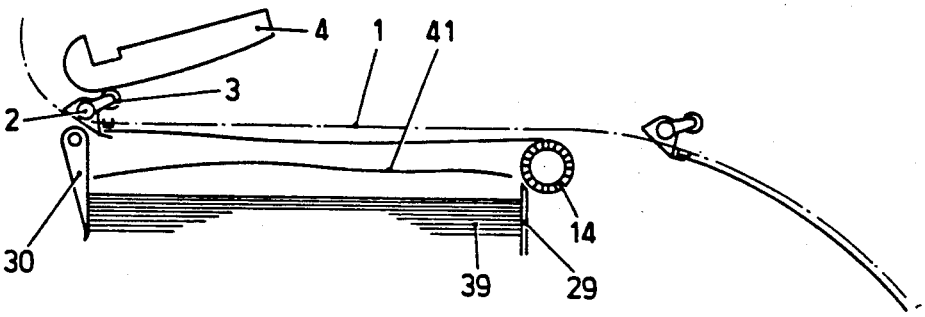
FIGS. 1 to 4 are in the form of diagrammatic side views of a sheet-delivery apparatus, showing the influences of the time of opening of the grippers and the speed of the suction wheels.

In FIG. 1, the machine is slowly starting up, so that the grippers which are carried by the feeder chains 1 and the gripper bars 2 may only open when the leading edge of the sheet has reached a position shortly in front of the paper stop 30. The peripheral speed of the suction wheels 14 approximately corresponds to the speed of the chains 1. The falling sheet indicated by reference numeral 41 then falls without any problems onto the stack of sheets 39 and, as the next gripper array slowly moves towards the stack 39, there is also no collision with the preceding sheet, which has already dropped down to a sufficiently low level. The fans (not shown here) which produce the top air may run slowly, as only a small amount of top air-flow is required. With many kinds of paper, there is no need for a blast of air out of the nozzles of a rake-type blowing unit.

FIGS. 2 to 6 do not show the reference numerals set out in FIG. 1, as the same components are involved in all those drawings. In the view shown in FIG. 2, the machine is running quickly. The grippers must already be open when the leading edge of the sheet is still really far from the paper stop 30. The peripheral speed of the suction wheels 14 must be relatively low, compared to the speed of the chains 1, so that the suction wheels produce a greater braking action. By virtue of its own kinetic energy, the sheet gently reaches the paper stop 30 promptly and without suffering damage at its leading edge. It then passes in an orderly fashion and sufficiently quickly downwardly onto the stack 39, more specifically by virtue of the use of a stronger top-air flow which causes it to be thrust downwardly and stabilized with a strong blast of air out of the nozzles of a rake-like blowing unit. That ensures that the subsequent gripper system does not catch the sheet still in its path of movement and push it together to form a crease or crumple, which immediately results in the machine's being switched off, by virtue of triggering off the means for safeguarding against crumpled or creased sheets, which is installed in the usual manner.

Figure 2:
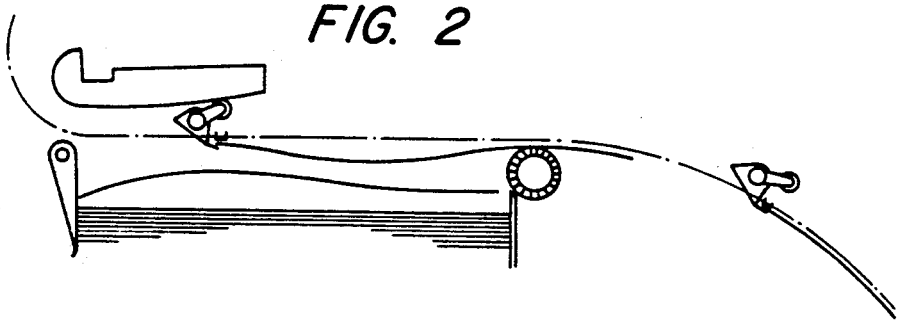
Figure 5:
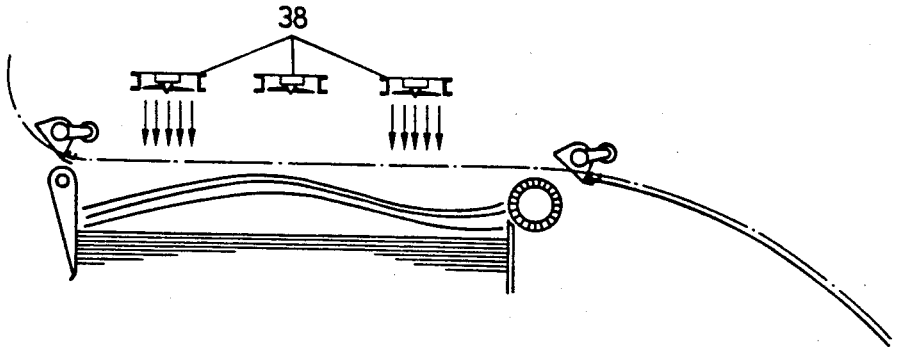
FIGS. 5 and 6 are views corresponding to FIGS. 1 to 4, showing the influence of the blowing-air fans, the so-called "top air", which are not shown in FIGS. 1 to 4.
Figure 6:
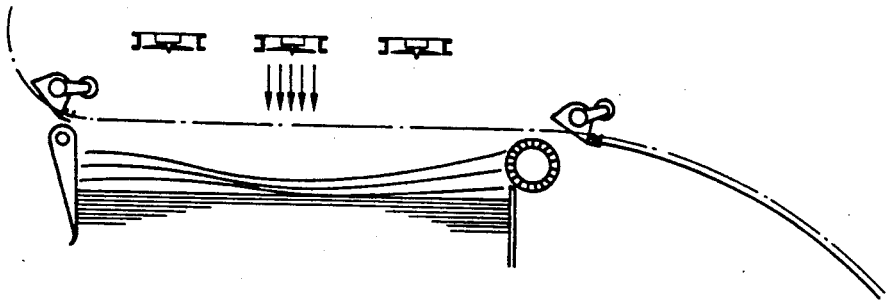

It will be appreciated that there is an infinite range of variation between the modes or operation shown in FIGS. 1 and 2, being primarily dependent on the machine speed, the sheet format size, the sheet weight (we only have to consider the difference between bible paper and heavy cardboard or other materials), the height of drop, the strength of the suction effect at the suction wheels 14, the peripheral speed of the suction wheels 14 in relation to the speed of the chains 1, and thus of the individual sheets, the strength of the action of the fans 38 producing the top-air flow (which will be described in greater detail hereinafter with reference to FIGS. 5 and 6), the blast jets of greater or lesser strength from the blast pipes 37 of the blowing unit, and also the setting of the blowing-air devices, which is a crucial factor. If the blowing or sucking air-feed devices are not set in the optimum fashion, this results in stray turbulence phenomena and thus also in undesired stoppages.

Figure 3:
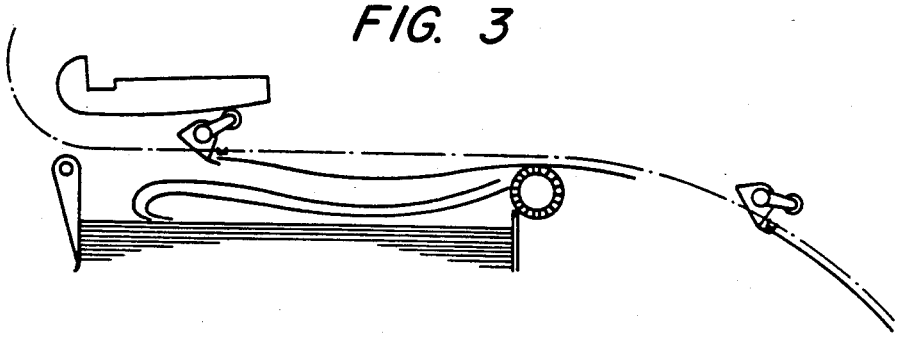
Figure 4:
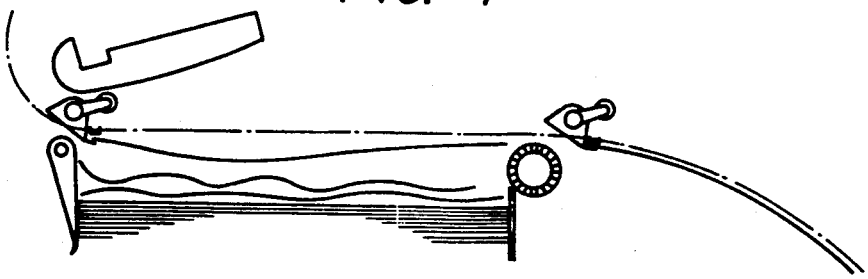

In the view shown in FIG. 3, the machine is also running slowly. However, the grippers are opening much too early and braking action of the suction wheels 14 is too great, because they are rotating at an excessively slow peripheral speed. The result of that is that the sheet comes into contact with the top of the stack 31 a long way in front of the paper stop 30, and thus rolls up, as illustrated. After just one or only a few sheets, this again also results in stoppages, because the sheets then move into the path of the gripper devices. The latter effect any also be caused by virtue of having the trailing edges of individual sheets which are to be deposited project up on front of the suction roller or wheels 14.

In the view shown in FIG. 4, the machine is again operating at speed. In this case, however, the grippers are opening much too late, so that the leading edge of the sheets strikes hard against the sheet stop 30, and suffered damage, and the entire sheet, depending on its structure, is concertina-ed together to a greater or lesser degree. That then also immediately results in stoppages. However, the even much worse case may occur, more particularly when the sheets are nonetheless properly aligned above the stack, but the leading edge, as already mentioned, retains deformation of greater or lesser magnitude. In that case, more particularly, in a possible second installation, the sheets can no longer be properly aligned in register, with the result that the entire print or substantial parts of a print become finally and completely wastepaper.

Little can be done to change any of that, even by altering the peripheral speed of the suction wheels, quite apart from the fact that, if the paper has a sensitive surface, it will be damaged due to an excessively severe braking action at a low peripheral speed and high vacuum in respect of the suction wheels 14, due to the rubbing or scouring effect at that point. It will be appreciated that that can also occur under all other conditions if the suction wheels are not at their optimum setting in regard to their peripheral speed.

With the setting of the fans 38 shown in FIG. 5, namely, with the fans producing flows of air directed against the sheet chiefly in the leading and trailing regions of the sheet in question, a cushion of air of a bell-like configuration is very quickly formed under the sheets as they drop down onto the stack, and the air cannot escape sufficiently quickly. As soon as the cushion of air begins to project into the region of the path of the grippers, the machine once again comes to a stop, especially as the capacitive stack-level-regulating means 40 which is arranged between the paper stops can only produce any control action at the edge of the stack 39 and not at the centre where the highest point of the bell-shaped air cushion is to be found.

The setting in respect of the top air as shown in FIG. 6 is correct in principle. The air between the downwardly moving sheets can escape in an outward direction, and no bell-shaped air cushion is formed under the sheets as they drop down onto the stack. However, the necessary condition here is also that the strength of the blowing action is not excessive at the centre, as otherwise the sheets may possibly not be straightened out on the top of the stack if they are premature in coming into excessive contact with the sheet which is disposed therebelow. That is then a consequence of friction and adhesion of the printing ink which is still not entirely dry and/or also an electrostatic charge.

At the leading and trailing ends of the sheets, the air flow directed thereonto should as far as possible only be of such a strength that the sheets are also held out of the path of movement of the grippers, but nonetheless still tend towards the position shown in FIG. 6.

It should be noted at this point that, in place of the fans 38, it is also possible to provide other kinds of blowing-air sources which have the same action and which are regulatable and which act at a point.

Figure 7:
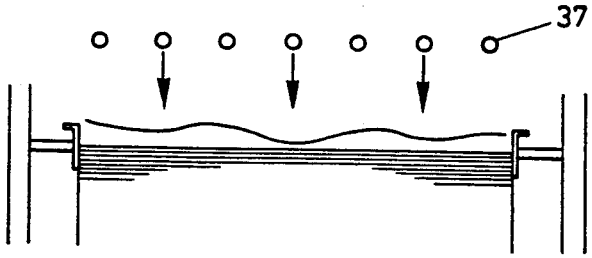
FIG. 7 shows the influence of the air-blast nozzles which are used in many cases, also being referred to as "rake-like blast units"

FIG. 7 shows the arrangement of the blowing pipes 37 of the rake-like blowing unit, more specifically, in contrast to FIGS. 1 to 6, viewing in the direction of movement of the sheets. This arrangement can also be seen in FIG. 8 which will be described hereinafter. The blowing pipes 37 of the blowing unit, which each have air nozzles that are arranged close together over the entire length thereof and which are directed downwardly are to perform the function of stabilizing and in addition urging downwardly particularly flimsy sheets when they have reached the stack chamber, by means of a suitable strong blast of air. The stabilization effect is produced by having a wavy or corrugated configuration, as shown, temporarily imparted to the sheet. In that respect, all possible variations can be used; more particularly, such are also dependent on the sheet format. When the present invention is used, the blowing pipes can be individually activated or deactivated by means of electromagnetic valves.

The foregoing examples, which are only a few, showing the individually required settings on the delivery device in the correct combination in relation to the respective print carrier in accordance with its format, its weight per unit of area, its structure, its speed, its tendency to roll, its speed of drop, its height of drop, etc., clearly show how much the printer on the machine is needed to preset the sheet-delivery device and also always to keep it in optimum adjustment while the machine is running.

A problem also occurs whenever the machine is in the start-up or shut-down phase (rising or falling speed). In such phases, the overall adjustment which has once been set for steady-state or continuous printing speed may not be the proper adjustment and may therefore also not function properly, so that the start-up and shut-down phase very often involves a whole pack of waste sheets, which must be removed, and to be accurate that may occur during each of those periods of time during which the printer should actually be devoting himself to the quality of printing of the printed product. In that connection, the start-up and run-down phases are also repeated in the event of any stoppage which, in turn, is generally caused by having the individual adjustable elements of the delivery device be not at the optimum settings.

Figure 8:
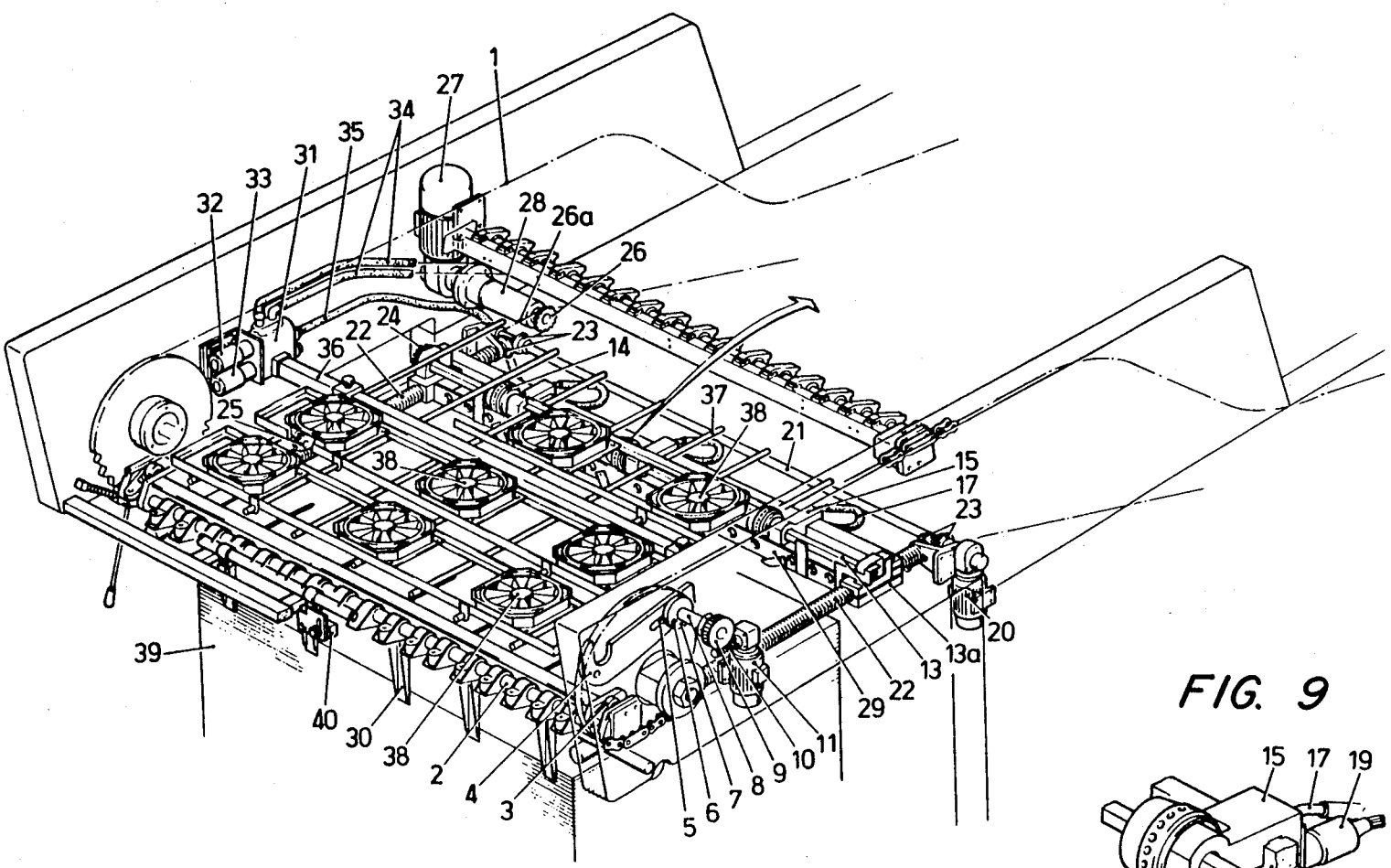
FIG. 8 is a perspective view of a sheet-delivery apparatus in the region in which the sheets are deposited upon the stack, not with the various adjusting means.

FIG. 8 shows a delivery apparatus according to the invention which various centrally controlled servo- or control motors and electromagnetic valves. The individual, centrally-controlled remote adjustments with feedback to the reference-value generator or setting means (generally by way of potentiometers) are carried out, in detail, as follows:

Format setting:

This is effected by means of a drive motor 20 by way of a connecting shaft 21, a pair of bevel gears 23, and two screw-threaded spindles 22, which are respectively mounted at both ends in supports on the side wall. The screw-threaded spindles 22 carry the complete suction-wheel slider or carriage 13*a*, which, with corresponding screw-threaded nuts, moves the suction wheel shaft 13 or the suction roller forwards or backwards in the direction of movement of the paper, thereby setting the arrangement to the format size. The rear-sheet stops for precise paper stacking are also disposed on the complete suction-wheel carriage 13*a*. Format width can be set in the same manner, by way of the lateral straight thruster or push member.

Hitherto, this adjustment had to be effected by means of a hand wheel and a detecting device, both operating by way of the connecting shaft 21, and individual adjustment of the lateral sheet pusher members on both sides of the sheet feeder.

Speed of rotation of the suction wheels (peripheral speed in relation to the speed of the feed chains):

A drive motor 27, by way of a drive stub portion 28 and a sprocket 26, drives a roller chain 26*a* which also passes over a further sprocket 25. A sprocket 24 which is fixed on the suction-wheel shaft 13 meshes in all format settings in the upper run of the roller chain 26*a* and entrains the suction wheels 14. The speed of the suction wheels can be regulated at the drive motor 27, more specifically, not only in proportion to the speed of rotation of the machine but also in accordance with any other procedures or interrelationships. It would also be possible, for example, to vary the speed of the suction wheels while each individual sheet is passing through.

Strength of the suction at the suction wheels:

In first form and perfecting printing, that is to say, when the sheets are freshly printed on both sides, it is not possible to use the suction wheels 14 as a braking means without smearing the fresh ink on one side of the sheet. Without the braking action of the suction wheels, however, the machine can only be operated relatively slowly, and it is therefore advantageous for the suction wheels to be displaceable laterally, so that they can be positioned in print-free spaces of the overall print image. In situations in which individual suction wheels do not have such print-free spaces, then compressed air is blown out of the vacuum nozzles of the suction wheels and the sheet is locally held away from the suction wheel in order to prevent the above-mentioned smearing from occurring. In the case of a fully continuous print form which does not have any free space at all, it may be necessary for air to be blown out of all suction wheels. In that case, a reduced printing speed must be accepted.

Hitherto, this operation or individually converting from reduced pressure to compressed air, in regard to all or individual ones of the suction wheels, was effected manually and in a really uncomfortable position, with the machine stationary (because of the risk of accidents).

By using, in accordance with the invention, electromagnetic valves which are fitted into the feed conduit to each of the suction wheels 14, this entire procedure can be carried out by remote control and can even be programmed for repeat orders.

The valves and some conduits are not shown in FIG. 8.

Adjustment of the gripper-opening cam:

A drive motor 11, by way of a worm 10 and a worm gear 9, rotates a control shaft 8 and thereby a flange 7 carrying an eccentrically positioned control pin 5 which is disposed in a slot 6 in the gripper-opening cam 4 and which, when the control motor 11 is set in operation, causes adjustment of the cam 4.

Hitherto, instead of a remote-controllable transmission motor of that kind, the machine had a hand wheel for adjusting the gripper-opening cam.

Speed of rotation of the fans (local variations in top air):

The fans 38 are chiefly driven individually or in longitudinal or transverse series or in a diagonal row or in any mix, at a higher or lower speed, or however are also switched off entirely.

In that connection, the choice of the mode of operation depends on the properties of the respective print carrier (sheet or material).

It may be, for example, that the sheet is being printed over its full area on the right-hand half or on the left-hand half, while the other half remains entirely or predominantly free. Due to the weight of the ink, the sheet falls more quickly on the side which has the more heavily printed area, so that it is necessary for the top-air flow generated by the fans to be set at a higher value over the half which is not printed or which is more slightly printed, or possibly the fans over the half which is more heavily printed must be entirely switched off. With the apparatus according to the invention, all of this can be done centrally in accordance with the values stored for the respective application of printing.

If the printing machine has an automatic ink-zone control means, including a computer, in accordance with individual zones, then those values can also be utilized for the adjustment of the fans referred to herein, because the crucial distribution of the ink is stored in the computer for the inking mechanism.

Another problem arises when very small formats are to be dealt with. Although the fans are displaceable in a lateral direction and also in the direction of movement of the sheets, some of them are, however, outside the format; that also applies, moreover, in regard to the blowing pipes 37 of the blowing unit. However, blowing air-flow outside the format results in interference in the movement of the paper and in the deposit thereof, because such air flow gives rise to vagrant or stray air flows and turbulence, with its attendant problems. Therefore, in accordance with the invention, switching on and switching off of the fans and the blowing pipes are coupled to automatic format adjustment.

Hitherto, the fans were requlated by means of their own independent control transformers, in part also in series, by means of rotary knobs, which was a fairly time-consuming operation, just by virtue of the relatively large number of fans involved.

Control of the pressure blast from the blowing pipes of the blowing unit:

This adjustment is made by means of a control motor 33 and the transverse pipe 36 of the rake-like blowing unit, to which the blowing pipes 37 are connected. The term "rake-like blowing unit" means the complete array of individual blowing pipes 37 on the transverse pipe 36. Cyclic control of the respective short-term air blasts is effected in known manner by means of a control cam on a single-revolution shaft and an electromagnetic valve.

Hitherto, adjustment of the strength of the compressed-air blast was effected by a separate manual valve with a rotary knob and a scale.

Figure 9:
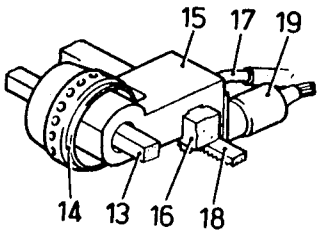
FIG. 9 is a perspective view on an enlarged scale of a means for transverse adjustment in respect of a suction wheel, which may additionally be provided and which can also be remote-controlled.

Axial displacement of the individual suction wheels:

It has already been briefly mentioned hereinbefore that, if the freshly printed side of a sheet (more particularly, in perfecting printing) is drawn over the suction wheels 14, the suction wheels are displaced laterally in order to bear against the sheet as far as possible in regions which do not bear any printing. A further embodiment of the invention, which relates to that concept, substantially shortens the overall task of pre-setting of the delivery apparatus, in that the setting of the individual suction wheels in the axial direction thereof is also remote-controlled, and the precisely correct positions of the suction wheels can be stored for repeat orders. The mechanism provided for that purpose is shown in FIG. 9. The suction-wheel carriers 15 each carry a drive motor 19, the pinion of which is engaged with a transversely extending toothed rack 18 which is fixed to the suction-wheel slide or carriage 13*a*.

In comparison, hitherto the suction wheels could only be displaced when the machine was stationary, because of the risk of an accident, and also only by working in a really uncomfortable position. Re-setting is also frequently required because the space without any printing thereon is too small and does not pass through the machine entirely on the proper and correct line. For that purpose however, the machine must then be stopped again.

Figure 10:
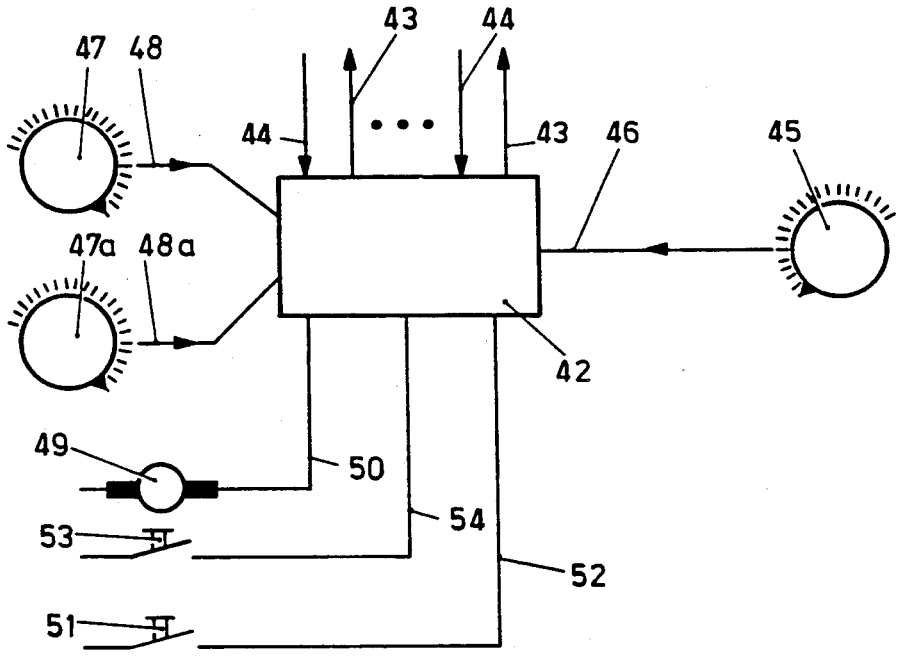
FIG. 10 is a highly simplified view of an electrical circuit diagram for the apparatus according to the invention.

FIG. 10 shows the heart of the electrical-electronic control and regulating apparatus, namely, the reference-value-storage means or memory with characteristic computing means and possibly memory and computer, generally denoted by reference numeral 42. Therefrom respective lines 43 go to the individual control motors or electromagnetic valves, and associated with those feed lines 43 which go to control motors, there are respective lines 44 for the actual values in respect of the various settings, such actual values.

Connected to the reference-value memory, the characteristic-computing means, the computer, and the memory with interchangeable memory elements, there is an input means 45 for paper weight, with a corresponding scale, being connected thereto by way of line 46; and also an input means 47 for the sheet-format length, also with a scale, by way of line 48; an input means 47*a* for sheet-format width, with scale, by way of line 48*a;* and also a tachogenerator 49 which supplies the computer 42 with an analog signed corresponding to the speed of rotation of the machine, by way of line 50. also connected to the computer 42, if there is provided therein a memory with interchangeable memory elements, is a switch 51 for switching over from manual to automatic mode, the switch 51 being connected to the computer 42 by way of a line 52, and a switch 53 for putting data into storage, the switch 53 being connected to the computer 42 by way of line 54. When the arrangement is set with the switch 51 set to the manual mode and with selection of the elements to be adjusted in the feeder, at 42, the respective element is set to the optimum setting feeder, at 42, the respective element is set to the optimum setting and that setting is then put into storage in the respective storage element used, by actuation of the switch 53. In that way, all adjustable elements are first successively moved into the optimum position by hand, or valves are switched on or off, and the values relating thereto are then all put into storage by actuation of the switch 53.

The input means in respect of paper weight, format length, and format width, as well as in respect of the speed of rotation of the machine, may operate in a analog fashion, for example, using potentiometers, adjustable capacitors, or adjustable throttle or choke means, or however, they may operate digitally.

When dealing with many more or less normal print orders, there will be no need for storage of all possible settings. On the contrary, in that case, when altering the speed of rotation of the machine or adjusting paper weight or the sheet format, the various adjustable elements of the feeder are set and regulated in accordance with a family of characteristics, once it has been introduced.

In the case of repeat orders (reproductions), if the printer, in the case of the first order, put the optimum values into storage in a storage element, the printer can use that storage element and call up the stored values, in which respect all functions are then automatically preset to their optimum values and however are still automatically readjusted, to correspond to the speed of rotation of the machine.

For longitudinal adjustment of the suction wheels 14, there is no need to go by way of the reference-value-setting means 42; on the contrary, that may be coupled directly to the format setting for the format length. In substance, the same considerations also apply in regard to transverse setting of the lateral pusher members, which may be directly coupled to the format-width setting; it will be appreciated that a necessary condition for that purpose is the provision of control motors for transverse setting of the lateral pusher members.

Obviously, selector keys or buttons must be provided on the reference-value-setting means 42, for the individual settings that are provided. They are used both when the correct values which have been empirically determined are put into storage in a memory, but also when, in the case where, although a stored program is being otherwise used in its entirety, there are some altered external factors that are to be take into account, for example, altered air temperature, air humidity, paper qualities, or the like, and for that purpose, a particularly defined setting (or some settings) are to be modified in comparison with the values which were previously stored as a complete program for the same print operation.

The manual setting means for the individual adjustable elements of the arrangement should certainly not be omitted in any case, so that, for example, in the event of failure of a control motor, production can be continued by making the associated adjustment by hand, possibly by way of an interposed releasable coupling means, so that the manual adjustment can be separated from the control motor. The same could then obviously also be used to modify individual settings, deviating from the program which has just taken place, by hand instead of by way of the reference-value-setting means, in comparison with that program.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. An apparatus for controlling and regulating a sheet-delivery device wherein individual sheets are removed therefrom by means of gripper arrays mounted to two circulating, mutually parallel chains and guided above a receiving stack past a transversely-extending row of rotary suction means which apply physical action to each sheet, over which receiving stack the grippers are opened by means of a gripper-opening cam which is adjustable to provide for timing the gripper-opening action, and wherein the peripheral speed of the rotary suction means and the pressure applied thereat are adjustable and the longitudinal setting of the rotary suction means is adjustable in the direction of sheet movement for purposes of adaptation to different sheet-format lengths, and wherein, for altering at least two of the following values (a) to (e):

(a) the speed of rotation of the rotary suction means;

(b) the longitudinal setting of the rotary suction means;

(c) the pressure at the rotary suction means and the switching of the same on and off and the switching thereof over from suction to blowing air;

(d) the location of said gripper-opening cam for timing of the sheet grippers; and (e) the speed of rotation and the switching on and off of fans which slow downwardly onto the sheet to facilitate the stacking action;

there are provided respective separate control means for the ones of said values which are to be regulated, a reference-value-setting means, means for feedback of the present-value setting with respect to said values to be controlled to said reference-value-setting means, the reference-value-setting means being provided with an input for values corresponding to the paper weight, the sheet format, and the speed of rotation of the machine, said reference-value-setting means being operatively connected with a computer which computes the reference values for all settings of the feeder, such reference values being determined empirically for each operating condition and being stored in the form of a family of characteristics, said computer emitting signals corresponding to said reference values to the reference-value-setting means, and said means transmitting signals corresponding to said values to said control motors for said ones of said values to be controlled.

2. Apparatus according to claim 1, in which there are provided a control motor and a feedback means to the reference-value-setting means with respect to the values for transverse adjustment of said suction wheels.

3. Apparatus according to claim 2, said apparatus comprising a memory means with interchangeable memory elements, which is connected to the reference-value-setting means, a first switch which is connected to the said memory means, and which can be switched over from a "manual" setting to an "automatic" setting of the adjustable elements of the said sheet-delivery device, and a second switch which is also connected to the said memory means for putting into storage in the said memory means, as a family of characteristics, optimal values for operation of said sheet-delivery device which have been empirically determined by operation of said device with manual setting of said values.

4. Apparatus according to claim 1, said apparatus comprising a memory means with interchangeable memory elements, which is connected to the reference-value-setting means and or its computer, a first switch which is connected to the said memory means, and which can be switched over from a "manual" setting to an "automatic" setting of the adjustable elements of the said sheet-delivery device, and a second switch which is also connected to the said memory means for putting into storage in the said memory means, as a family of characteristics, optimal values for operation of said sheet-delivery device which have been empirically determined by operation of said device with manual setting of said values.

5. Apparatus according to claim 4, in which the operations of activating and de-energizing given longitudinal and transverse rows of the fans for generating the top air and longitudinal pipes of the rake-like blowing unit are coupled into the format adjustment.

6. Apparatus according to claim 1, wherein means are provided such that the longitudinal setting of the suction wheels is coupled to the format adjustment for format length.

7. Apparatus according to claim 1, wherein means are provided such the transverse setting on the lateral-straight line thruster means is coupled to the format adjustments for format width.

* * * * *